US005529529A

United States Patent [19]

Judge et al.

[11] Patent Number: 5,529,529

[45] Date of Patent: Jun. 25, 1996

[54] CYLINDER LINER MICROFINISHING APPARATUS AND METHOD

[75] Inventors: Norman R. Judge, Dewitt; Edward E. Judge, Lansing, both of Mich.

[73] Assignee: Industrial Metal Products, Corporation, Lansing, Mich.

[21] Appl. No.: 297,874

[22] Filed: Aug. 30, 1994

[51] Int. Cl.[6] ..... B24B 1/00

[52] U.S. Cl. ..... 451/51; 451/59; 451/61; 451/168; 451/464; 451/470; 451/491; 451/492; 451/504; 451/513; 451/512; 451/904; 451/481

[58] Field of Search ..... 451/51, 59, 61, 451/168, 180, 221, 381, 392, 394, 397, 398, 462, 464, 466, 467, 470, 481, 484, 486, 491, 504, 505, 512, 513, 514, 492, 493, 904

[56] References Cited

U.S. PATENT DOCUMENTS

| | | | |
|---|---|---|---|
| 2,115,461 | 4/1938 | Hartmann . | |
| 2,164,811 | 7/1939 | Floss . | |
| 2,165,566 | 7/1939 | Meakin . | |
| 2,313,442 | 3/1943 | Kline . | |
| 2,791,871 | 5/1957 | Johnson | 451/481 |
| 2,797,531 | 7/1957 | Seborg | 451/481 |
| 2,988,859 | 6/1961 | Chaffey | 451/481 |
| 3,060,648 | 10/1962 | Gjertsen | 451/470 |
| 4,094,103 | 6/1978 | Ebelt | 451/381 |
| 4,099,350 | 7/1978 | Hasty | 451/470 |
| 4,145,845 | 3/1979 | Ebelt | 51/34 F |
| 4,328,647 | 5/1982 | Gillette et al. | 51/338 |
| 4,643,055 | 2/1987 | Contoyonis | 82/30 |
| 4,707,944 | 11/1987 | Parsons | 51/34 F |
| 4,991,361 | 2/1991 | Huppert et al. | 51/346 |
| 4,993,190 | 2/1991 | Hiyoshi et al. | 51/145 T |
| 5,359,818 | 11/1994 | Costa | 451/512 |

FOREIGN PATENT DOCUMENTS 878511 11/1981 U.S.S.R. .

*Primary Examiner*—Bruce M. Kisliuk
*Assistant Examiner*—Eileen P. Morgan
*Attorney, Agent, or Firm*—Harness, Dickey & Pierce

[57] ABSTRACT

An apparatus for microfinishing an interior cylindrical surface. The apparatus includes a mechanism which holds and rotates the workpiece about an axis. A tool, having radially directed work areas, is positioned within the workpiece and causes a strip of abrasive sheet material, positioned over the work areas, to engage the rotating workpiece. With the abrasive sheet material engaging the rotating workpiece, the tool is axially oscillated.

30 Claims, 2 Drawing Sheets

54
52
50
40
56
62
68
72
16
78
58
60
70
3
3
74
80
64
84
82
66
76
70
82
84
60
58
4
4
74
80
78
84
82
83
84
82

CYLINDER LINER MICROFINISHING APPARATUS AND METHOD

BACKGROUND AND SUMMARY OF THE INVENTION

This invention generally relates to the microfinishing of workpieces. More particularly, the invention relates to an apparatus and method for microfinishing and truing the interior cylindrical surface of a workpiece such as an engine cylinder liner.

It is common for the combustion cylinders of an internal combustion engine, and in particular large diesel engines, to be fitted with removable cylinder liners. These liners are positioned within the engine block so that when damage or wear becomes apparent, the liner can be easily and relatively inexpensively replaced. Without a removable cylinder liner, the damaged cylinder would require resizing of the pistons, reboring or replacement of the engine block, all of which are expensive repair procedures.

The cylinder liner itself is a seamless tube having a cylindrical interior surface whose diameter closely corresponds to that of the piston. The interior cylindrical surface of the liner must exhibit a diameter within close tolerances of the piston diameter and also must have precise microfinish characteristics. Since the direct forming of cylinder liners within such tolerances has; proven difficult, the interior cylindrical surfaces have typically been machined to a rough diameter and then are microfinished by apparatuses such as stone honing machines.

Stone honing machines used for machining and truing interior cylindrical surfaces include a tool that is adapted to be axially moved while it is rotated about a central axis within the liner. The abrasive stones are spaced circumferentially around the tool so that their finishing surfaces face radially outward. When the tool is rotated, the stones are biased radially outward so that the stones abrade the inner cylindrical surface. By axially moving the tool through the cylinder, the entire inner surface is machined.

While the tools work effectively, the stones themselves have exhibited a tendency to crack or chip and therefore must be frequently replaced and require a significant amount of tool maintenance. Also, the stones experience form changes due to uneven wear caused by the uneven surface of the workpiece itself. Since the uneven wear of the stones will not enable the stones to provide a uniform machining action, subsequently machined parts will contain errors or defects. Additional limitations of stone honing machines include the considerable expense of the stone hones and the limited abrasive performance of the stone hones themselves. Moreover, since the abrasive tools are typically compliantly mounted, they tend to follow any geometric imperfections in the cylinder bore as opposed to correcting them.

As described in U.S. Pat. No. 4,991,361, an apparatus used for machining and truing the inner cylindrical surfaces of a tube uses abrasively coated film material over pressure members which force the film to abrade the surface. When in use, the tool, including the film material which is carried on a spool within the tool, is axially moved while being rotated.

While honing apparatuses using abrasive film material according to the above referenced patent appears workable, it is believed to have certain shortcomings. The machining rate of such an apparatus would be limited because, over the course of machining, only a small total area of film material is actually in contact with the workpiece resulting in a low rate of material removal. A further limitation in the above referenced apparatus is that the film material is stored in the tool which limits the amount of film which can be stored, necessitating frequent refilling of the spools.

It is therefore desirable to provide an apparatus which achieves a high rate of material removal from the interior cylindrical surface of a workpiece while producing an extremely consistent smooth surface with the special finish required by engine manufacturers to reduce engine emission output. It is an objective of the present invention to provide a microfinishing apparatus which achieves these desires.

It is another object of this invention to provide a microfinishing apparatus in which a large supply of abrasive film material can be made available for use thereby decreasing the frequency witch which the supply roll must be changed.

Another objective is to provide a cylinder microfinishing apparatus which is capable of exerting an increased amount of working force on the cylindrical surface for more effective machining. This is achieved in part by spacing apart a number of working areas mounted to a rigid body tool element engaging the workpiece. The use of rigid body tool elements further aids in providing correction of geometry imperfections in the workpiece.

The tool according to this invention can be used in various manners. In one embodiment, the machine includes a headstock which receives and holds the workpiece without obstructing access to the interior cylindrical surface. Once secured within the headstock, the workpiece is rotated about a working axis which is generally coaxial with the axis defined by the rough interior cylindrical surface.

The microfinishing tool of this invention has first and second halves or shoes that are themselves rigid and capable of being outwardly forced apart from one another. Each half of the tool defines pressure surfaces located at circumferentially spaced positions which press the abrasive coated film against the workpiece. By circumferentially spacing the pressure surfaces of the tools, the forces exerted against the workpiece surface are greater than the force separating the tool halves.

A supply of abrasive film material is remotely located relative to the tool and is mounted so that the film material wraps over the tool axially. The film material axially extends over the pressure surfaces during microfinishing to increase the percentage of film material in contact with the cylinder liner during microfinishing and enables the supply of film to be remote from the tool.

In accordance with the invention, the tool is positioned within the liner and the two shoes of the tool are biased radially outward causing the abrasive film material to contact the interior cylindrical surface of the liner. Relative axial and rotational movement between the tool and workpiece occurs so that the entire cylindrical surface of the workpiece is microfinished and a desired crosshatched microgroove pattern is formed in the surface. The abrasive film material is provided so that a single strip of film material extends axially over one pressure area on each of the tools, effectively enabling a single piece of the abrasive film material to contact the workpiece along two diametrically opposing strips. This approach reduces the number of supply rolls which are needed, enables more efficient use of the abrasive film material, and ensures a high rate of material removal.

The novel tool according to this invention can be used with various machine tool configurations. For example, the liner's longitudinal axis can be vertical or horizontal during machining. Configurations in which the tool rotates, and in which the workpiece is held stationary or vice versa are possible, or both elements can be moved together. If desired, oscillating motions as opposed to complete rotations of the tool or workpiece could be implemented.

Additional, benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE PREFERRED EMBODIMENT

Figure 1:
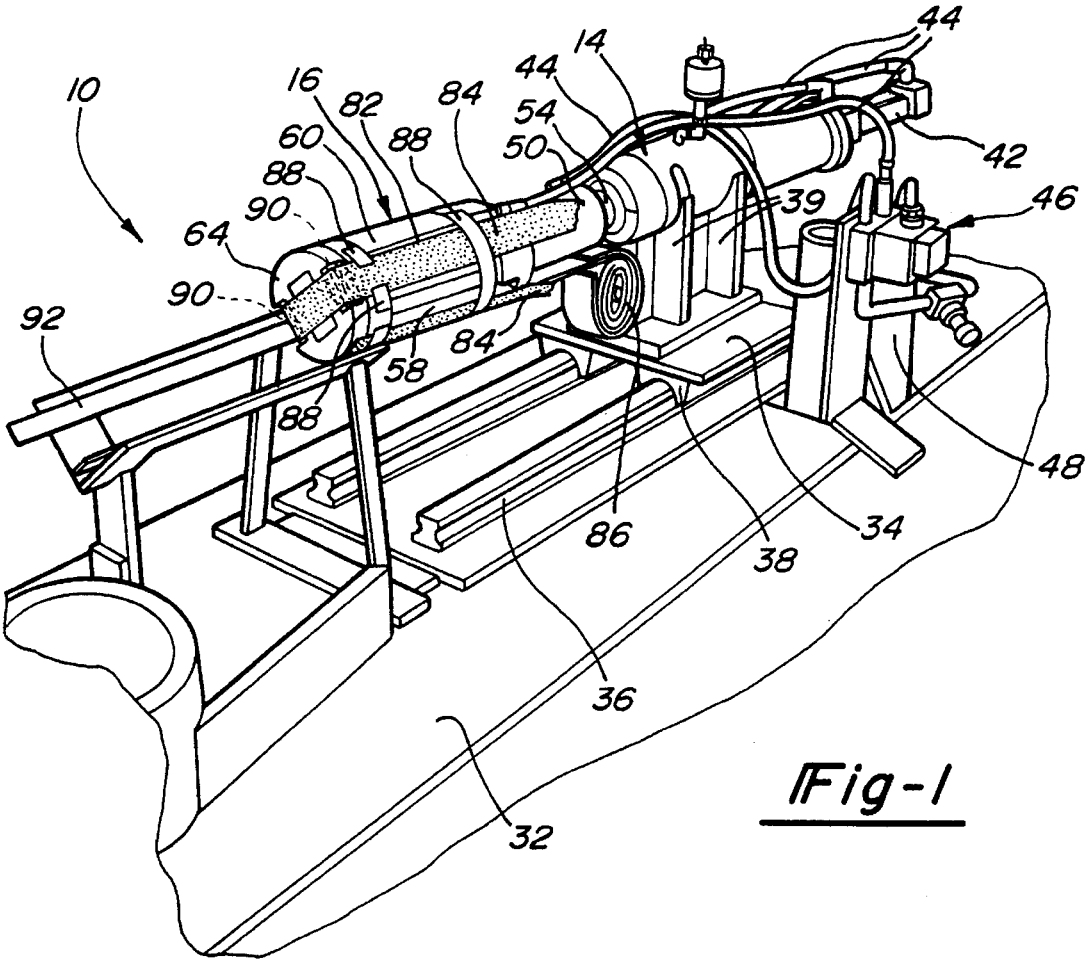
FIG. 1 is a perspective view of one portion of a microfinishing apparatus embodying the principles of the present invention.

Referring now to the drawing, the present invention provides a microfinishing apparatus for the interior cylindrical surface of a workpiece, such as a cylinder liner, as illustrated in FIG. 1 and generally designated at 10. The apparatus 10 includes tooling which comprises a principal feature of the invention as well as an embodiment of machine tool components for using the tool. The apparatus 10 principally includes a headstock 12, a tailstock 14 and a tool 16.

Figure 2:
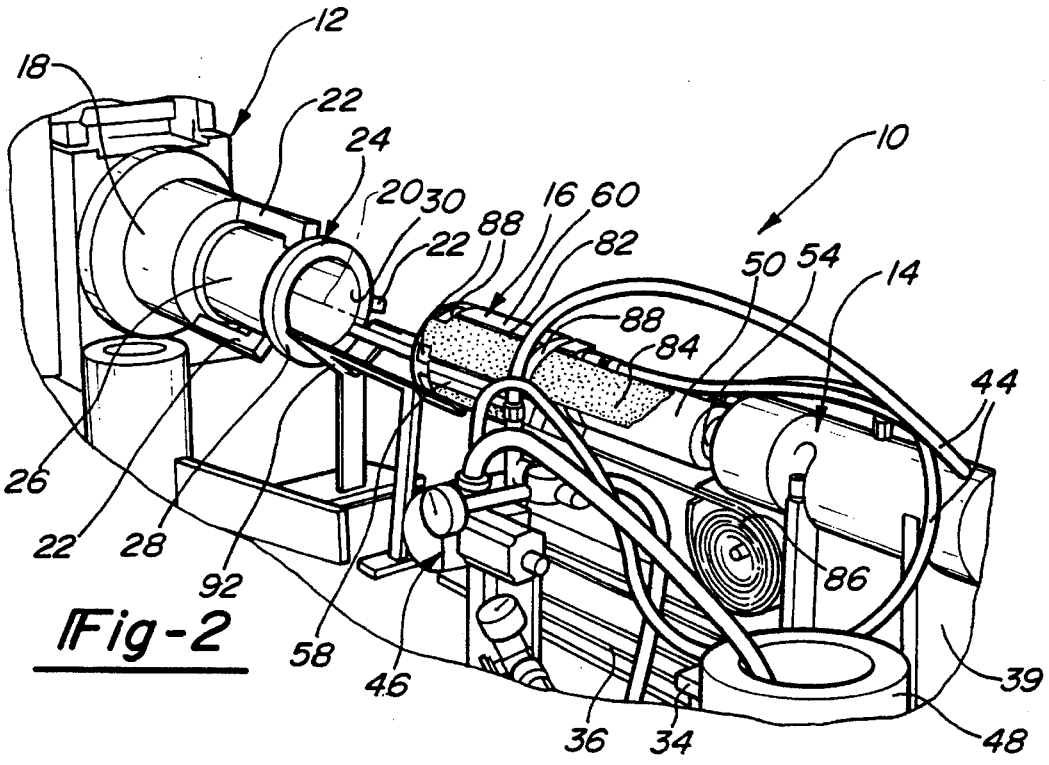
FIG. 2 is another perspective view of the present invention, in a direction generally opposite of that in FIG. 1, showing the mechanism used for holding and rotating the workpiece.

A workpiece, hereinafter referred to as cylinder liner 24, is held and rotated by the headstock 12. The headstock 12 includes a spindle 18 which is rotated by a motor (not shown) about a working axis, generally designated at 20, of the apparatus 10. The spindle 18 is provided with a mechanism that will hold and orient the cylinder liner 24 so that the axis defined by its interior cylindrical surface 30 will be generally coaxial with the working axis 20. A variety of mechanisms for holding the cylinder liner 24 in the headstock 12 can be used with the present invention. One such mechanism is a three-jawed chuck or clamp 22 as generally illustrated in FIG. 2. The jaws or arms of the clamp 22 are shown grasping the exterior surface of the cylinder liner's cylindrical body 26, immediately behind a flange 28 located at one end of the cylindrical body 26. Grasping the exterior of the cylinder liner 24 leaves the interior cylindrical surface 30 free for microfinishing. Alternatively, the cylinder liner 24 could be mounted to a simulated engine block on the headstock 12 so that the working axis 20 corresponds to that of a piston used with the liner 24.

The tailstock 14 is movable relative to the headstock 12 and is mounted on a frame 32. This mounting enables the tool 16, located on one end of tailstock 14, to be moved into and out of a working position where it engages and microfinishes the interior cylindrical surface 30 of the cylinder liner 24.

Movement of the tailstock 14 and tool 16 is accomplished through the employment of a hydraulic cylinder (not shown) which drives and moves a tailstock base 34 along a pair of rails 36 or similar guide structures. Accordingly, the base 34 is provided with a pair of supports 38 which engage the rails 36 and allow the base 34 to slide therealong. By manipulating the hydraulic cylinder which controls the position of the base 34, the tool 16 can be moved between its working position (where it is located within the cylinder liner 24) and a non-working position where it is retracted from the cylinder liner 24.

Mounted on risers 39 above the base 34, the tailstock 14 further includes an engagement cylinder 40 and an oscillation cylinder 42, both preferably of the hydraulic type. These hydrauliic cylinders 40 and 42 operate independently of one another and are connected by several hydraulic lines 44 to a hydraulic control system, generally designated at 46. The control system 46 may be automated or manually operated and may include pressure regulators, pressure gauges and other control features, in addition to a hydraulic fluid reservoir 48. These cylinders 40 and 42 can be actuated generally along the working axis 20.

The engagement cylinder 40, that hydraulic cylinder located nearest the tool 16, is mounted within a casing 50. The casing 50 is connected at its rearward end by a universal joint 52 to a ram 54 of the rearwardly mounted oscillation cylinder 42. Similarly, the forward end of the casing 50 is connected to the tool 16 by a universal joint designated at 56. The provision of the two universal joints 52 and 56 enables the tool 16 to self-aligning itself within the cylinder liner 24 and along the working axis 20 of the headstock 12.

Figures 3, 4:
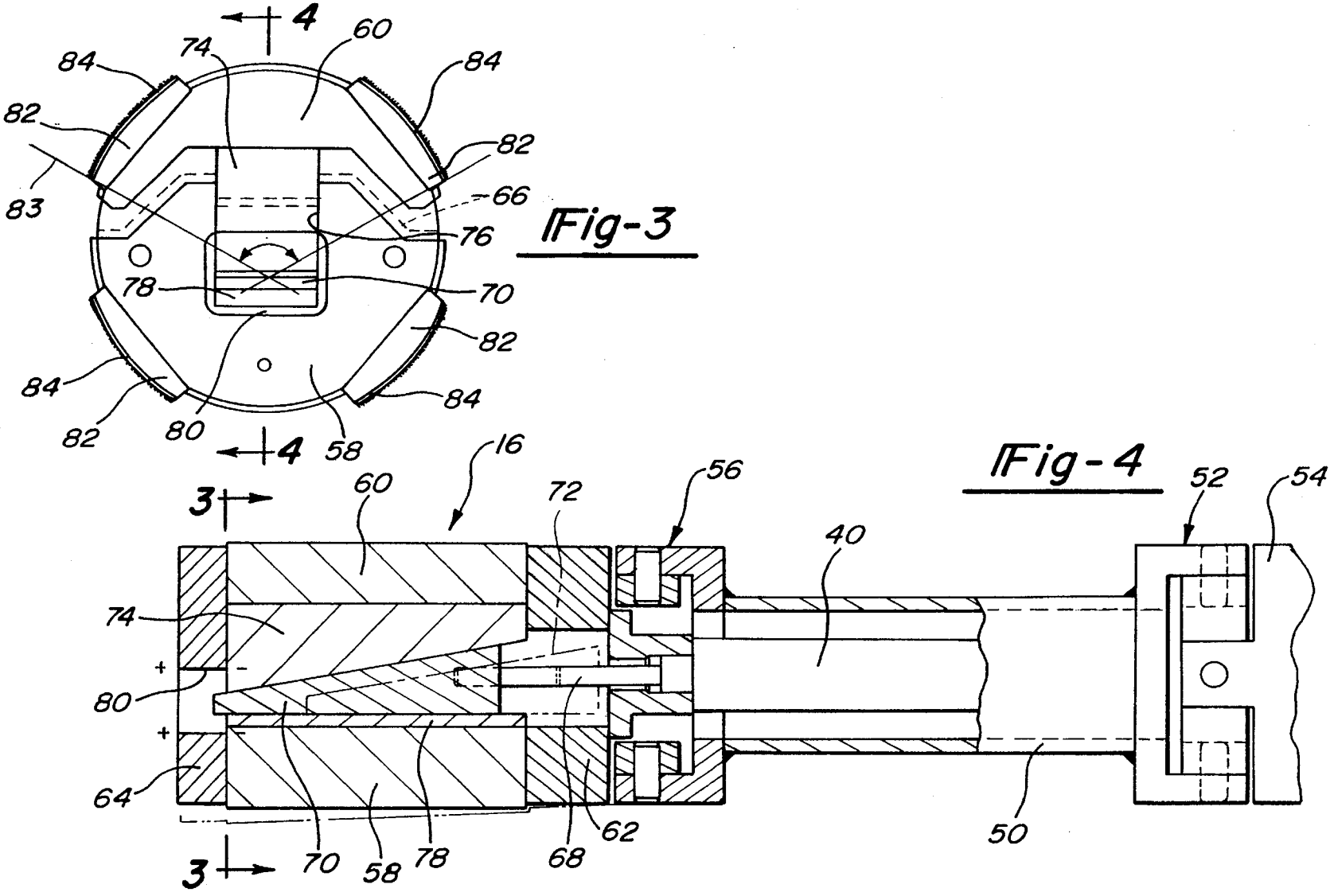
FIG. 3 is a transverse sectional view substantially along line 3—3 in FIG. 4 through the tool utilized in the present invention.
FIG. 4 is a longitudinal sectional view substantially along line 4—4 in FIG. 3 through the tool utilized in the present invention.

The working portion of the tool 16 includes a pair of longitudinal halves or shoes 58 and 60 which are each rigid but radially movable relative to one another. The shoes 58 and 60 are carried between a pair of end caps 62 and 64 which support the shoes 58 and 60 in a fashion which enables them to move relative to one another. As such, one shoe 58, the lower shoe, may be rigidly secured by fasteners between the end caps 62 and 64 while the remaining shoe 60, the upper shoe, is retained between the end caps 62 and 64 in a slidable mounting. As seen in FIG. 3, the shoes 58 and 60 are shown in their radially outward position. The disengaged position is generally designated by the upper shoe 60 being shown in phantom at 66 in its retracted location. The engagement cylinder 40 causes this radial movement of the shoes 58 and 60.

To radially bias the shoes 58 and 60 apart, the engagement cylinder 40 is actuated by the hydraulic control system 46 and its ram 68 is extended. The ram 68 carries a wedge-shaped driver 70 on its end which is positioned between the shoes 58 and 60 so that the inclined surface of the driver 70 is in contact with a portion of the movable shoe 60. When the movable shoe 60 is in its disengaged position 66, the ram 68 and the driver 70 will be retracted, as designated in phantom at 72.

As seen in FIGS. 3 and 4, the movable shoe 60 includes a lower extension 74 which fits within a corresponding slot 76 defined in the lower shoe 58. The driver 70 is also positioned within the slot 76 and rests upon a bearing plate 78 attached to the lower shoe 58 which allows the driver 70 to more easily move between its extended and retracted positions. When extended by the ram 68, the inclined surface of the driver 70 engages an inclined surface of the extension 74 of the shoe 60 causing the extension 74 to ride up the driver 70 moving the upper shoe 60 radially outward relative to the lower shoe 58. To maintain a compact construction for the tool 16 while accommodating the required movement of the driver 70, an aperture 80 is defined in the distal end cap 64 so that the "nose" of the driver 70 can extend the aperture 80 when the driver 70 is in its extended position. The inclined surface of the driver 70 and the inclined surface of the upper shoes extension 74 are angled with respect to the bearing plate 78 and the lower shoe 58 such that, regardless of the amount of force applied to the upper shoe 60, it will be difficult to back drive the driver 70. This angle generally approaches a locking angle and is preferably about fifteen degrees (15°) when measured from the bearing plate 78. By approaching a locking angle, high separation forces are generated as compared with the force exerted by ram 68. A true locking angle however, is intentionally avoided so that the shoes are able to retract when pressure from the ram 68 is relieved.

Each shoe 58 and 60 has an arcuate outer surface and cooperates with the end caps 62 and 64 to provide the tool 16 with a generally cylindrical shape. The shoes 58 and 60 also each carry a pair of radially directed pressure inserts 82. The inserts 82 are constructed of a hard material such as honing stone material or roughened or coated metal and are spaced apart around the circumference of the tool 16 so that an insert 82 on one shoe is generally diametrically opposed from an insert 82 on the other shoe. The exterior surfaces of the inserts are arcuate and substantially conform to the curvature desired in the finished cylinder liner 24. For reasons further described below, the pressure inserts 82 on each shoe 58 or 60 are circumferentially spaced apart from one another at an angle which is herein referred to as the wrap-around angle 83.

Positioned over the exterior surface of the inserts 82 is a strip of abrasive film material 84 such as one of the polyester microfinishing films manufactured by the 3M Corporation. The abrasive film material 84 is provided from a pair of supply rolls 86, only one of which is shown, mounted on the tailstock 14 at a remote location away from the tool 16. Take-up rolls (not shown) cooperate with the supply roll 86 and receive the used or loaded abrasive film material 84 after microfinishing.

For each pair of diametrically opposed inserts 82, the abrasive film material 84 extends from the supply roll 86, in an axial direction along the length of the tool 16 and over the radial surface of an insert 82. At the distal end of the tool 16, the abrasive film material 84 wraps around a roller 90 on the end of the tool 16, is reversed in direction and passes axially back over the remaining insert 82, on the other shoe, of the opposed pair. The film material 84 is then taken up by the take-up roll mentioned above.

To maintain the abrasive film material 84 on the tool 16 and to guide it over the inserts 82 and the end of the tool 16, the tool 16 utilizes guide Straps or bands 88 mounted to each of the end caps 62 and 64 and aligned with the inserts 82 and rollers 90. The bands 88 extend circumferentially on the tool 16 and allow the abrasive film material 84 to be inserted between the band 88 and the remainder of the tool 16. The guide rollers 90 at the end of the tool 16 reverse the axial direction of the abrasive film material 82 and direct it back through another series of bands 88 over the diametrically opposed insert 82 of the remaining shoe. Since two strips of the abrasive film material 84 are used, the distal end cap 64 of the tool 16 is provided with two sets of guide rollers 90. The guide rollers 90 are axially offset from one another and allow the strips of abrasive film material 84 to overlap or crisscross each other as they traverse the distal end of the tool 16.

With the shoes 58 and 60 each being rigid and biased in radially opposite directions, the incorporation of the two pressure inserts 82 on each shoe 58 or 60 and a wrap around angle of at least ninety degrees (90°), and preferably about one hundred and twenty degrees (120°), enables a greater net force to be transferred to the cylinder liner 24 during microfinishing than if the inserts 82 were "in-line" with the biasing force since a "wedge angle" effect is provided. This ensures that the tool 16 aids in establishing the shape of the liner 24 and that the subsequent liners do not carry defects because of uneven shoe wear. In addition to this increased microfinishing force, an increased rate of material removal is achieved by the present invention over previous designs. Two features help achieve this high rate of material removal. As seen in FIGS. 3 and 4, four sections of the abrasive film material 84 simultaneously engaging the cylinder liner 24 with this engagement being provided over substantially the full length of the tool 16 and liner 24. Also, by providing the abrasive film material 84 in an axial direction and engaging a significant length of the material 84 with the liner 24, after microfinishing the inner surface of the cylinder liner 24 is straighter and more true. It is further significant that each insert 82 receives a fresh supply of microfinishing film 84 which criss-cross over the nose of the tool. By indexing fresh film into the liner, a consistent surface finish part-to-part is achieved.

Because of the universal joints 52 and 56, when not inserted into the cylinder liner 24, the tool 16 is supported on a raised skid 92. The skid 92 relieves stress on the various components resulting from the weight of the tool 16 and it being positioned on the end of the tailstock 14. In addition to supporting the tool 16 in its non-use position, the skid 92 also operates to direct the tool 16 into the cylinder liner 24 at the beginning of the operating cycle.

Once the tool 16 has been positioned within the cylinder liner 24, the cylinder liner 24 is rotated and the shoes 58 and 60 actuated to engage the abrasive sheet material 84 with the interior cylindrical surface 30 of the liner 24. The tool 16 is also axially reciprocated or oscillated by the oscillating cylinder 42 mentioned above. The interaction of the rotating cylinder liner 24 and the axial oscillation of the tool 16 requires the abrasive film material 84 to be physically retained in position over the inserts 82 by the guide bands 88 and the guide rollers 90 mentioned above.

With the cylinder liner 24 being rotated in a direction ninety (90) degrees from the working axis 20, the oscillation of the tool 16 forms a desired series of crosshatched microgrooves in the interior cylindrical surface 30. By varying the rate of rotation of the cylinder liner 24 and the rate of oscillation of the tool 16, the angle of the crosshatched microgrooves relative to the working axis can be varied and controlled as desired.

As mentioned previously, alternate approaches of machining with tool 16 can be utilized such as vertical mounting or rotating the tool with a fixed or movable workpiece. As an alternative to continuous rotation, rotary oscillation through an arc can be accomplished. Moreover, relative rotation followed by reversal could be used. In any of these cases, the benefits provided by tool 16 according to this invention could be realized.

While the above description constitutes the preferred embodiments of the present invention, it will be appreciated that the invention is susceptible to modification, variation and change without departing from the proper scope and fair meaning of the accompanying claims.

We claim:

1. A tool for microfinishing an interior cylindrical surface of a workpiece using a strip of microfinishing film comprising:

a pair of tool shoes each defining a pair of axially extending work surfaces spaced at circumferentially spaced positions, said work surfaces being spaced apart by wrapping angle so as to enable a greater net force to be transferred to the interior cylindrical surface as said tool shoes are urged apart, means for guiding and supporting said film against said axially extending surfaces and for providing a supply of said film remote from said tool whereby said supply is outside of said interior cylindrical surface when said tool is within said interior cylindrical surface during microfinishing thereof, and actuation means for urging said tool shoes to separate within said interior cylindrical surface whereby pressure is applied by said work surfaces against said film and said workpiece surface.

2. The tool according to claim 1 wherein said means for guiding and supporting said film causes a first strip of said film to extend axially along one of said tool shoes, wrap over ends of both of said tool shoes and extend axially over the other of said tool shoes.

3. The tool according to claim 1 wherein said first and a second of said strips of said film extend along said tool shoes.

4. An apparatus as set forth in claim 1 wherein said octuation means includes a driver adapted to be advanced between said first and second tool shoes thereby forcing said first and second tool shoes radially apart.

5. An apparatus as set forth in claim 1 wherein said driver includes a ramped surface which is inclined relative to said axis, said ramped surface engaging a portion of one of said tool shoes when advanced thereby causing said first and second tool shoes to thereby move apart.

6. An apparatus as set forth in claim 5 wherein said ramped surface defines an angle generally approaching a locking angle.

7. An apparatus as set forth in claim 5 wherein said ramped surface defines an angle of about fifteen (15) degrees.

8. An apparatus as set forth in claim 2 wherein each of said tool shoes includes at least two work areas defined thereon, said work areas being circumferentially spaced at least ninety (90) degrees apart on each of said tool shoe.

9. An apparatus as set forth in claim 8 wherein said work areas are circumferentially spaced about one hundred twenty (120) degrees on each of said tool shoes.

10. An apparatus as set forth in claim 8 wherein said work areas are of honing stone material.

11. An apparatus for microfinishing an interior cylindrical surface of a workpiece, said apparatus comprising:

holder means for holding the workpiece;

rotation means for rotating the workpiece about an axis;

a tool having a plurality of radially directed work areas spaced about said tool, said tool including biasing means for biasing said work areas in a radial direction; said work areas being spaced apart at a wrapping angle so as to enable a greater net force to be transferred to the interior cylindrical surface as said work areas are biased in said radial direction;

a supply of abrasive film material, said abrasive film material being provided to extend substantially the length of said tool and axially over said work areas, said abrasive film material engaging and microfinishing the interior surface of the workpiece during radial biasing of said work areas; and oscillation means for oscillating said tool along said axis while said abrasive film material is engaged with the interior surface of the rotating workpiece thereby microfinishing the interior surface of the workpiece.

12. An apparatus as set forth in claim 11 wherein said tool includes first and second shoes, said first and second tools each having at least one work area defined thereon, said biasing means causing said first and second shoes to move radially apart relative to one another.

13. An apparatus as set forth in claim 12 wherein said biasing means includes a driver adapted to be advanced between said first and second shoes thereby forcing said first and second shoes radially apart.

14. An apparatus as set forth in claim 13 wherein said driver includes a ramped surface which is inclined relative to said axis, said ramped surface engaging a portion of one of said shoes when advanced thereby causing said first and second shoes to thereby move apart.

15. An apparatus as set forth in claim 14 wherein said ramped surface defines an angle generally approaching a locking angle.

16. An apparatus as set forth in claim 14 wherein said ramped surface defines an angle of about fifteen (15) degrees.

17. An apparatus as set forth in claim 12 wherein each of said shoes includes at least two work areas defined thereon, said work areas being circumferentially spaced at least ninety (90) degrees apart on each of said shoe.

18. An apparatus as set forth in claim 17 wherein said work areas are circumferentially spaced about one hundred twenty (120) degrees on each of said shoes.

19. An apparatus as set forth in claim 11 wherein said work areas are of honing stone material.

20. An apparatus for microfinishing an interior cylindrical surface of a cylinder liner, said apparatus comprising:

a headstock having means for holding the workpiece, said headstock also including rotation means for rotating the workpiece about an axis;

a tailstock being axially movable relative to said headstock;

a tool supported by said tailstock and mounted for axial movement with said tailstock relative to said headstock, said tool including a first shoe and a second shoe, said first and second shoes being radially movable relative to one another in opposite directions, said shoes each having a pair of radially directed work areas, individual work areas of each of said pairs being circumferentially spaced at least ninety degrees apart from one another;

biasing means for radially biasing said shoes apart from one another along a biasing axis;

a first strip of abrasive film extending substantially the length of said tool and axially over one of said work areas of said first shoe member, said first strip also extending axially over one of said work areas of said second shoe;

a second strip of abrasive film extending substantially the length of said tool and axially over the other of said work areas of said first shoe, said second strip also extending axially over the other of said work areas of said second shoe, said first and second strips of abrasive film being adapted to engage the interior cylindrical surface of the workpiece in response to radial biasing of said first and second shoes relative to one another thereby causing removal of material and microfinishing of the interior cylindrical surface of the workpiece; and reciprocating means for axially reciprocating said tool and said first and second strips of abrasive film generally along said axis while said first and second strips of said abrasive film are in contact with the interior cylindrical surface of the workpiece.

21. An apparatus as set forth in claim 20 wherein said biasing means includes an actuator and a driven member, said driven member being movable by said actuator between said first and second shoes to radially bias said first and second shoes apart causing said abrasive film to engage the interior cylinder surface of said cylinder liner.

22. An apparatus as set forth in claim 21 wherein said actuator is a hydraulic cylinder.

23. An apparatus as set forth in claim 20 wherein said reciprocating means includes a hydraulic cylinder having a ram coupled to said tool and whereby reciprocation of said ram causes reciprocation of said tool.

24. An apparatus as set forth in claim 20 wherein said tool includes centering means for allowing said tool to center within said cylinder liner along said axis.

25. An apparatus as set forth in claim 24 wherein said centering means includes a pair of universal joints coupled to said tool.

26. An apparatus as set forth in claim 20 wherein said work areas on each shoe are spaced at least ninety degrees apart from one another.

27. An apparatus as set forth in claim 20 wherein said work areas of each shoe are spaced circumferentially apart from said biasing axis and at least one hundred and twenty degrees apart from one another.

28. A method of microfinishing an interior cylindrical surface of a workpiece, said method comprising the steps of:

providing a workpiece having an interior cylindrical surface to be microfinished;

rotating said workpiece about an axis;

providing a tool including a plurality of work areas;

providing a supply of abrasive film remote from said tool, locating a strip of abrasive film material axially over each of said work areas so as to extend substantially the length of said tool;

locating said tool and said strips of abrasive film material within said workpiece;

actuating said tool to cause said strips of abrasive film material to engage and contact said interior cylindrical surface of said workpiece thereby microfinishing said interior cylindrical surface; and reciprocating said tool and said strips of abrasive film material along said axis as said strips of abrasive film material is in contact with said interior cylindrical surface.

29. The method of claim 28 wherein said work areas of said tool are defined on at least two radially movable shoes and wherein said engaging step includes the step of radially biasing said shoes apart to cause outward engagement of said strips of film material with said interior cylindrical surface of said workpiece.

30. The method of claim 28 wherein said strip of abrasive film material extends generally about an axial end of said tool and over two of said work areas.

* * * * *

UNITED STATES PATENT AND TRADEMARK OFFICE

CERTIFICATE OF CORRECTION

PATENT NO. : 5,529,529

DATED : June 25, 1996

INVENTOR(S) : Norman R. Judge and Edward E. Judge

It is certified that error appears in the above-indentified patent and that said Letters Patent is hereby corrected as shown below:

Column 7, Line 1, after "each" insert --tool shoe--.

Signed and Sealed this

Tenth Day of September, 1996

*Attest:*

Bruce Lehman

BRUCE LEHMAN

*Attesting Officer*

*Commissioner of Patents and Trademarks*